US009180644B2

(12) United States Patent
Townsend

(10) Patent No.: US 9,180,644 B2
(45) Date of Patent: Nov. 10, 2015

(54) ADDITIVES WITH CLOUD POINTS TO IMPROVE EFFICIENCY OF RELEASE AGENTS

(71) Applicant: Georgia-Pacific Chemicals LLC, Atlanta, GA (US)

(72) Inventor: David F. Townsend, Grayson, GA (US)

(73) Assignee: Georgia-Pacific Chemicals LLC, Atlanta, GA (US)

( * ) Notice: Subject to any disclaimer, the term of this patent is extended or adjusted under 35 U.S.C. 154(b) by 0 days.

(21) Appl. No.: 14/135,440

(22) Filed: Dec. 19, 2013

(65) Prior Publication Data

US 2014/0190644 A1 Jul. 10, 2014

Related U.S. Application Data

(60) Provisional application No. 61/748,781, filed on Jan. 4, 2013.

(51) Int. Cl.

| | |
|---|---|
| ***D21H 21/14*** | (2006.01) |
| ***B31F 1/12*** | (2006.01) |
| ***D21H 27/02*** | (2006.01) |

(52) U.S. Cl.

CPC ..... *B31F 1/126* (2013.01); *D21H 21/146* (2013.01); *D21H 27/02* (2013.01)

(58) Field of Classification Search

CPC ..... D21H 21/146; D21H 27/02; B31F 1/126
USPC ..... 508/263; 523/402; 524/503
See application file for complete search history.

(56) References Cited

U.S. PATENT DOCUMENTS

| | | | | |
|---|---|---|---|---|
| 4,434,008 | A * | 2/1984 | Dumm et al. | C08L 91/06 106/10 |
| 5,730,839 | A * | 3/1998 | Wendt et al. | 162/111 |
| 2002/0015721 | A1* | 2/2002 | Simonnet et al. | 424/427 |
| 2011/0284176 | A1* | 11/2011 | Ringold et al. | 162/111 |

OTHER PUBLICATIONS

Lubrizol, Bioadhesion, Pharnaceutical Bulletin 23, May 31, 2011.*
Han et al., Effect of Additives on the Cloud Point of Polyethylene Glycols, 1984, Arch. Pharm. Res. 7(1), p. 1-9.*
DOW Anser Center, Surfactant Basics—Defintion of Cloud Point and Its Importance, Jul. 22, 2014.*

* cited by examiner

*Primary Examiner* — Anthony Calandra
(74) *Attorney, Agent, or Firm* — Ram W. Sabnis

(57) ABSTRACT

This disclosure relates to papermaking and the use of creping adhesive and release agent compositions used in papermaking. In one aspect, there is provided a new class of release agents and compositions comprising release agents, the release agent comprising: a) a release agent comprising a quaternary imidazoline compound, an imidazoline free base, an oil-based dispersion, or a combination thereof; and b) a polyether component selected from a polypropylene glycol (PPG), a co-polymer of propylene glycol and ethylene glycol (co-PPG-PEG), a blend of polypropylene glycol (PPG) and polyethylene glycol (PEG), and a combination thereof, wherein the release composition has a cloud point in water at standard pressure from about 1° C. to about 98° C. There are also provided creping compositions having a cloud point, comprising an adhesive composition and a release composition as described.

18 Claims, No Drawings

ADDITIVES WITH CLOUD POINTS TO IMPROVE EFFICIENCY OF RELEASE AGENTS

CROSS-REFERENCE TO RELATED APPLICATIONS

This application claims the benefit of U.S. Provisional Patent Application No. 61/748,781, filed Jan. 4, 2013, the disclosure of which is incorporated by reference herein in its entirety.

FIELD OF THE INVENTION

This disclosure broadly relates to papermaking and the use of creping adhesive and release agent compositions and especially relates to the manufacture of grades of paper that are suitable for preparing paper towels, napkins, facial tissue, and bathroom tissue.

BACKGROUND OF THE INVENTION

Paper manufacture is generally carried out by producing a slurry of cellulosic fibers in water containing a variety of additives and subsequently removing most of the water to form a thin paper web. The structural integrity of the paper arises, in large part, from mechanical entanglement of the cellulosic fibers in the web and hydrogen bonding between fibers.

With paper intended for use as tissue and towel products such as facial tissue, bathroom tissue, paper towels, napkins and the like, the level of structural integrity arising from the paper-making process conflicts somewhat with the degree of perceived softness that is necessary for consumer acceptance of such products. The most common method of increasing the perceived softness of tissue and towel products is to "crepe" the paper by mechanically compacting paper in the machine direction. The creping action imparts a fine, rippled texture to the sheet, increases the bulk of the sheet, and results in improved softness and absorbency, as well as providing other changes in physical properties such as stretch, particularly when measured in the machine direction.

Generally, creping is accomplished by fixing the moist, cellulosic paper web to a rotating thermal drum commonly known as a Yankee dryer, by applying the web onto the surface of the dryer onto which has been sprayed an adhesive composition and often one or more release agent or composition, generally in the form of an aqueous solution, emulsion or dispersion. The surface of the Yankee dryer is continuously sprayed with the adhesive/release agent composition, and the cellulosic web is subsequently and continuously applied, and the paper dries rapidly from hot air impinging on the exposed side of the paper as well as conductive heat transfer from the drum. It is generally thought that as the paper dries, hydrogen bonds form between the fibers and a flat and dense web morphology is created. The web then is scraped backwardly upon itself and off of the Yankee dryer by means of a flexible blade, termed a doctor blade, a creping blade, or simply a creper. This creping process causes a substantial number of inter-fiber bonds to break, altering the physical-chemical characteristics of the web, and increasing the perceived softness of the resulting tissue and towel products.

The art of obtaining good crepe quality relies on obtaining and maintaining the proper level of adhesion between the paper web and the Yankee dryer. Inadequate adhesion can result in poor or non-existing creping or require lower speed operations due to slow drying, while excessive adhesion can lead to poor sheet quality or cause the sheet to break, interfering with stable operation. Webs which are insufficiently adhered to the Yankee dryer can impact the control of the web as it travels between the creping blade and the winder upon which a roll of the paper is being formed, causing problems in forming a uniform roll of paper. For example, a loose sheet between the creper and the roll can cause wrinkles, foldovers, or weaving of the edges of the sheet and the like in the rolled-up paper, adversely affecting subsequent operations of tissue and towel manufacture. Therefore, considerable effort has centered around adjusting the balance between adhesion and releasability of the web, and combining these balanced factors with the right combination of web dryness at the crepe blade, blade angle, and other conventional parameters that govern creping.

Conventional release agents or release aids can alter the properties of an adhesive polymer and further can provide lubrication to the doctor blade, moderate the adhesive properties of the adhesive coating, and influence the release of the paper web from the Yankee dryer, all of which can affect the properties of the paper product. Some release aids are non-polar, neutral and non-water soluble compounds. Cationic release aids are also available and comprise water insoluble materials, such as imidazoline quaternary salts. Thus, tissue and towel paper quality and production efficiency can depend in part on the interaction of a release aid with both paper and adhesive. Depending upon the particular release agent or composition, the release mechanism can be related to an ionic interaction, for example, a cationic release agent's interaction with anionic cellulose fibers, and/or be related to a phase separation that occurs. Release aids also may be non-ionic, for example, may be oil based and thereby be associated with very different release mechanism.

While many advances in creping adhesives have been made in recent years, developments in new and modified release aids have lagged somewhat. There is a continuing need for new and useful release aids and in particular, new combinations of adhesive compositions and release aids with properties that allow more fine control over the adhesion-release balance. Desirably, new release aids and combinations of adhesives and release aids should offer a better means to manage the creping process by allowing better adjustments in adhesion, tack and rewetability, and release properties between the cellulosic fiber web and the surface of the Yankee dryer from which the paper is creped.

SUMMARY OF THE INVENTION

Among, other things, this disclosure provides for a new class of release agents and compositions comprising release agents, and further provides creping compositions that constitute new combinations of adhesive compositions and release agent compositions. Creping performance is dictated by the chemistry of binding and releasing the cellulosic web to the surface of the Yankee dryer drum, and the new release aid compositions use unconventional chemical and physical properties to improve performance.

Typically, existing conventional oil or non-oil release aids have a phase structure set before their application to the surface of the Yankee drier. In one aspect, this disclosure provides for a new class of release compositions that can change their phase structure and distribution when in contact with the adhesive, through phase separation that occurs after their application to the surface of the Yankee drier. For example, a change in phase structure and phase separation can occur owing to a temperature change or a dilution that effectively occurs following application to the Yankee surface. In a further aspect, both cationic and non-ionic classic release agents can be used in formulations that make up the new release compositions. Therefore, a further aspect of this disclosure provides that the ratio between release composition components, the ratio between adhesives and release composition components, the chemical structures of release composition components, the moisture content and temperature, and the like, can be manipulated to induce the correct phase separation to leads to improved performance.

In one aspect, there is provided a release composition for use in a creping process, in which the release composition can comprise:

a) a release agent comprising a quaternary imidazoline compound, an imidazoline free base, an oil-based dispersion, or a combination thereof; and b) a polyether component selected from a polypropylene glycol (PPG), a co-polymer of propylene glycol and ethylene glycol (co-PPG-PEG), a blend of polypropylene glycol (PPG) and polyethylene glycol (PEG), an alcohol polyether, an alkyl phenol polyether, and a combination thereof;

wherein the release composition has a cloud point in water at standard pressure from about 1° C. to about 98° C.

In accordance with another aspect, this disclosure provides a creping composition having a cloud point, the creping composition comprising an adhesive composition and a release composition, wherein the creping composition clouds at temperatures above its cloud point, and wherein the release composition can comprise:

a) a release agent comprising a quaternary imidazoline compound, an imidazoline free base, an oil-based dispersion, or a combination thereof; and b) a polyether component selected from a polypropylene glycol (PPG), a co-polymer of propylene glycol and ethylene glycol (co-PPG-PEG), a blend of polypropylene glycol (PPG) and polyethylene glycol (PEG), an alcohol polyether, an alkyl phenol polyether, and a combination thereof;

wherein the release composition has a cloud point in water at standard pressure from about 1° C. to about 98° C.

A further aspect of this disclosure provides a method of creping a cellulosic fiber web, the method comprising:

a) providing a creping composition having a cloud point, wherein the creping composition clouds at temperatures above its cloud point, the creping composition comprising a release composition, wherein the release composition comprises a release agent and a polyether component;

b) applying the creping composition having a first temperature to a drying surface having a second temperature higher than the first temperature;

c) contacting a cellulosic fiber web to the drying surface such that the cellulosic fiber web adheres to the drying surface; and d) dislodging the cellulosic fiber web from the drying surface;

wherein the cloud point of the creping composition is above the first temperature and below the second temperature.

By way of example, it has been unexpectedly discovered that blending release aids such as quaternary imidazolines with a polyether such as polypropylene glycol can produce a more efficient release agent for the operation of a Yankee drier than formulations of imidazolines without polypropylene glycol. Polypropylene glycol (also PPG or polypropylene oxide) is the polymer or oligomer of propylene glycol. Polypropylene glycols are exemplary of the polyethers that are useful because they impart a cloud point to the release composition and the creping composition comprising the release composition, in which clouding occurs upon heating the composition, rather than upon cooling the composition.

The cloud point is the temperature at which a mixture starts to phase separate and two phases appear, thus becoming cloudy. In the case of certain non-ionic surfactant oligomers or polymers containing polyoxyethylene and/or polyoxypropylene linkages, this cloud point feature exhibits reverse solubility versus temperature behavior in water, and therefore these polyether compositions "cloud out" at some point as the temperature is raised. In this disclosure, useful polyethers that can be used in the release composition include, for example, a polypropylene glycol (PPG), a co-polymer of propylene glycol and ethylene glycol (co-PPG-PEG), a blend of polypropylene glycol (PPG) and polyethylene glycol (PEG), and a combination thereof. If desired, an alcohol polyether, an alkyl phenol polyether, or various combinations that include these polyethers can be used as the polyether component. A range of different molecular weights and block copolymers of propylene glycol and ethylene glycol can be used in this application.

Any number of cationic and non-ionic release aids can be used in the release compositions of this disclosure. For example, imidazoline is a well know "non-oil" release component, which can provide excellent release, good lubrication, and softening effects to the resulting paper. Conventionally, imidazoline can be blended with polyethylene glycol (PEG) to adjust its viscosity, which can limit its ease of dispersion in water. Polyethylene glycol (PEG) is miscible in water at all temperatures and therefore it has the potential to undesirably modify the glass transition temperature (Tg) of the adhesive layer, rather than merely weakening the adhesion. One aspect of this disclosure is the use of polypropylene glycols (PPGs), alone or in certain co-polymers, co-oligomers, or blends, in which suitable polypropylene glycols include those that are insoluble in water at Yankee operating temperatures. As a result of this insolubility at Yankee temperatures, the polypropylene glycols do not modify the glass transition temperature (Tg) of the adhesive layer. Moreover, by clouding as a result of falling out of solution at Yankee temperatures, the polypropylene glycols (PPGs) can provide an oil-like effect that appears to boost the efficiency of the release. That is, polypropylene glycols (PPGs) can undergo a change in phase structure and distribution upon a temperature change or a dilution that effectively occurs following application to the Yankee surface while in contact with the adhesive. Since the art of obtaining good crepe quality relies on obtaining and maintaining the proper level of adhesion between the paper web and the Yankee dryer, this discovery provides an improvement in performance.

This disclosure further provides more general methods of making and using new release compositions. For example, there is provided a method of preparing a release composition, the method comprising:

a) combining a water insoluble release agent with a cloud point surfactant to form a first composition, wherein the cloud point surfactant exhibits reverse solubility versus temperature behavior in water; and b) combining the first composition with water to form a release composition, wherein the release composition is clear at room temperature and clouds at temperatures above room temperature.

There is further provided a method of using a release composition, the method comprising:

a) combining a water soluble polymer with a cloud point surfactant to form a miscible composition, wherein the cloud point surfactant exhibits reverse solubility versus temperature behavior in water; and b) combining the miscible composition with water to form a release composition, wherein the water soluble polymer phase separates from water upon combining the miscible composition with water.

This release composition according to either of these methods can be used with or without an included adhesive composition as disclosed in this disclosure. The release agent according to either of these methods can be selected from a quaternary imidazoline compound, an imidazoline free base, an oil-based dispersion, and any combination thereof. Further, the cloud point surfactant according to either of these methods can be a polyether component selected from a polypropylene glycol (PPG), a co-polymer of propylene glycol and ethylene glycol (co-PPG-PEG), a blend of polypropylene glycol (PPG) and polyethylene glycol (PEG), an alcohol polyether, an alkyl phenol polyether, and a combination thereof.

These and other aspects of the disclosure will be described and set forth in more detail in the Detailed Description and in the appended Claims.

DETAILED DESCRIPTION OF THE INVENTION

Among other things, this disclosure relates to a creping composition having a cloud point, the creping composition comprising an adhesive composition and a release composition as disclosed herein, wherein the creping composition clouds at temperatures above its cloud point. The term creping composition is used to refer generally to a creping adhesive composition that comprises an adhesive composition and a release composition, in which the release composition can comprise a release agent and a polyether component, selected and combined in a way that imparts clouding at Yankee drier operating temperatures. Release agents can comprise or can be selected from, for example, a quaternary imidazoline compound, an imidazoline free base, an oil-based dispersion, or a combination thereof. Polyether components can comprise or can be selected from, for example, a polypropylene glycol (PPG), a co-polymer of propylene glycol and ethylene glycol (co-PPG-PEG), a blend of polypropylene glycol (PPG) and polyethylene glycol (PEG), an alcohol polyether, an alkyl phenol polyether, and a combination thereof. In this aspect, the release composition has a cloud point in water at standard pressure and at any water temperature, for example, from about 1° C. to about 98° C. That is, the release composition can have a cloud point in water at standard pressure at any water temperature.

This disclosure further provides a method of creping a cellulosic fiber web, the method comprising:

a) providing a creping composition having a cloud point, wherein the creping composition clouds at temperatures above its cloud point, the creping composition comprising a release composition, wherein the release composition comprises a release agent and a polyether component;

b) applying the creping composition having a first temperature to a drying surface having a second temperature higher than the first temperature;

c) contacting a cellulosic fiber web to the drying surface such that the cellulosic fiber web adheres to the drying surface; and d) dislodging the cellulosic fiber web from the drying surface;

wherein the cloud point of the creping composition is above the first temperature and below the second temperature.

In a further aspect, the creping composition can further include an adhesive composition if so desired. By adjusting composition and operational parameters such that the cloud point of the creping composition is above the first temperature and below the second temperature, clouding occurs as a result of the polypropylene glycols (PPGs) falling out of solution at Yankee temperatures, which can provide an oil-like effect and boost the efficiency of the release. That is, composition and operational parameters are tailored so that the polypropylene glycols (PPGs) can undergo a change in phase structure and distribution upon a temperature change or a dilution that effectively occurs following application to the Yankee surface while in contact with the adhesive. This method of creping also involves other reactions that at take place at dryer temperatures on the dryer surface under the controlled conditions of the dryer, such as the adhesive composition resident on the dryer surface undergoing reactions such as thermosetting reactions and the like.

Release Composition

Release Agents.

In one aspect, the release compositions of this disclosure can comprise release aids or (agents) and a polyether component, in which the release agent can comprise or can be selected from a wide range of conventional release agents. Examples include, but are not limited to, non-polar, neutral and non-water soluble release aid compounds; cationic release aids that can be water-soluble or water insoluble materials; and the like. For example, water insoluble cationic release aids such as imidazoline quaternary salts are useful according to the methods of this disclosure.

In one aspect, suitable release agents can be selected from or can comprise a quaternary imidazoline compound, an imidazoline free base, an oil-based dispersion, or a combination thereof. Quaternary imidazoline compound have a positive charge on the imidazoline moiety that does not rely on protonation of the imidazoline and therefore is unaffected by pH changes. The positive charge is therefore retained in acidic, neutral, and basic environments. Several exemplary types of quaternary imidazoline release agents according to this disclosure are provided.

In one aspect, the release agent composition can be based on a quaternized imidazoline compounds, for example, methyl and ethyl sulfate salts of quaternary imidazoline derived from fatty acids. These fatty quaternary imidazolines can be blended with a polypropylene glycol or a copolymer of propylene glycol and ethylene glycol, particularly a block copolymer thereof, to produce a more efficient release agent for the operation of a Yankee direr than formulations of the fatty quaternary imidazolines without the polypropylene glycol or copolymer. The imidazolines function as non-oil release components, which impart excellent release, lubrication, and softening effects.

Conventional release aids, whether oil or non-oil, generally have their phrase structures set before their application to the Yankee dryer, which negates their phase behaviour as a factor affecting their release properties. While not intending to be bound by theory, it is thought that the present class of release aids can alter their phase structure and distribution in the adhesive upon phase separation under Yankee dryer operating conditions. Thus, it is thought that the blends of fatty (quaternary) imidazolines and polypropylene glycol or a copolymer thereof, can function by precipitating at their cloud point during drying, thereby inducing an oil-like effect of the composition in enhancing the efficiency of release. These features contrast to the effect of polyethylene glycol which is miscible in water at all temperatures it encounters during the process and thus has the potential of modifying the glass transition temperature of the adhesive instead of merely weakening the adhesion. Blends of quaternized imidazoline compounds with polypropylene glycol or a polypropylene glycol/polyethylene glycol block-copolymers are insoluble in water at Yankee dryer operating temperatures and therefore do not modify the Tg of the adhesive.

In one aspect and various embodiments, suitable quaternary imidazoline release agents for use in release compositions can comprise or be selected from a fatty quaternary imidazoline derived from a fatty acid. For example, the release agent comprises a methyl sulfate or ethyl sulfate salt of a fatty quaternary imidazoline derived from a fatty acid. Particularly useful release agents include those amidoethyl imidazoline compounds having the formula (I):

(I)

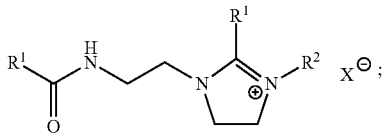

wherein $R^1$ can be selected independently from a hydrocarbyl group, for example, $R^1$ can be selected independently from a $C_6$ to $C_{22}$ hydrocarbyl moiety, $R^2$ can be methyl or ethyl, and X can be $[R^2SO_4]^-$. Thus, $R^1$ can be selected independently from a $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, $C_{22}$, $C_{23}$, or $C_{24}$ hydrocarbyl moiety. In a further aspect, $R^1$ can be selected independently from a saturated or an unsaturated $C_4$ to $C_{30}$ hydrocarbyl moiety. In addition, $R^1$ can be selected independently from a $C_4$ to $C_{30}$ alkyl, a $C_4$ to $C_{30}$ alkylene, and a $C_4$ to $C_{30}$ alkenyl.

According to a further aspect, other suitable quaternary imidazoline release agents can comprise or can be selected from hydroxyalkyl imidazolines. For example, hydroxyalkyl imidazolines can be selected from or can comprise hydroxyethyl imidazolines, as illustrated in the following structure (II):

(II)

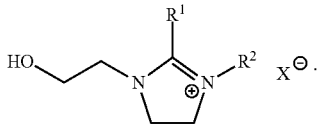

Still a further aspect provides that other suitable quaternary imidazoline release agents can comprise or can be selected from aminoalkyl imidazolines. For example, aminoalkyl imidazolines can be selected from or can comprise aminoethyl imidazolines, as illustrated in the following structure (III):

(III)

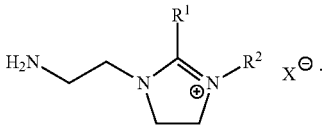

Generally, the substituents $R^1$, $R^2$, and X in (II) and (III) parallel those in structure (I). For example, $R^1$ in structures (II) and (III) can be selected independently from a hydrocarbyl group, for example, $R^1$ can be selected independently from a $C_6$ to $C_{22}$ hydrocarbyl moiety. Thus, $R^1$ can be selected independently from a $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, $C_{22}$, $C_{23}$, or $C_{24}$ hydrocarbyl moiety. In a further aspect, $R^1$ can be selected independently from a saturated or an unsaturated $C_4$ to $C_{30}$ hydrocarbyl moiety. In addition, $R^1$ can be selected independently from a $C_4$ to $C_{30}$ alkyl, a $C_4$ to $C_{30}$ alkylene, and a $C_4$ to $C_{30}$ alkenyl. Also in structures (II) and (III), $R^2$ can be methyl or ethyl, and X can be $[R^2SO_4]^-$.

Additional examples of particular fatty imidazolines, and their synthesis and properties are provided in D. Bajpai and V. K. Tyagi, Journal of Oleo Science, 2006, 55(7), 319-329, which is incorporated here by reference in pertinent part. For example, this reference illustrates known methods by which these fatty imidazoline compounds can be prepared and demonstrate the selection of precursors for designing and preparing any particular species of desired imidazoline compound.

Imidazoline free base compounds are also suitable for release agents for use in release compositions according to this disclosure. In some aspects and embodiments, suitable imidazoline free base compounds can comprise or can be selected from the non-salt forms of the imidazolines illustrated in formulas (I), (II), and (III). For example, the release agent can comprise or be selected from a fatty quaternary imidazoline derived from a fatty acid. Particularly useful release agents can comprise or be selected from amidoethyl imidazolines having the formula (IV)

(IV)

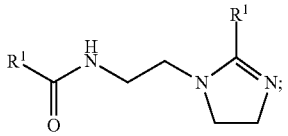

hydroxyethyl imidazolines as illustrated in the following structure (V):

(V)

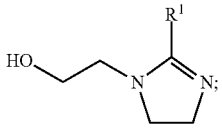

and/or aminoethyl imidazolines as illustrated in the following structure (III);

wherein $R^1$ can be selected independently from a hydrocarbyl group, for example, $R^1$ can be selected independently from a $C_6$ to $C_{22}$ hydrocarbyl moiety, $R^2$ can be methyl or ethyl, and X can be $[R^2SO_4]^-$. Thus, $R^1$ can be selected independently from a $C_6$, $C_7$, $C_8$, $C_9$, $C_{10}$, $C_{11}$, $C_{12}$, $C_{13}$, $C_{14}$, $C_{15}$, $C_{16}$, $C_{17}$, $C_{18}$, $C_{19}$, $C_{20}$, $C_{21}$, $C_{22}$, $C_{23}$, or $C_{24}$ hydrocarbyl moiety. In a further aspect, $R^1$ can be selected independently from a saturated or an unsaturated $C_4$ to $C_{30}$ hydrocarbyl moiety. In addition, $R^1$ can be selected independently from a $C_4$ to $C_{30}$ alkyl, a $C_4$ to $C_{30}$ alkylene, and a $C_4$ to $C_{30}$ alkenyl.

Release agents like the quaternary imidazoline release aid typically can be supplied as a mixture containing about 90% by weight imidazoline and about 10% by weight diethylene glycol, which then can be dissolved in a high boiling point solvent if desired. For example, 20 to 80% by weight of the quaternary imidazoline may be dissolved in 80 to 20% by weight of a solvent. For example, the solvent can be a mixture glycols and polyethylene glycols and other solvent components. By way of example, and not as limitation, a suitable solvent can be a mixture of (a) polyethylene glycol, having a weight average molecular weight of 200 to 600 Daltons (20 to 40% by weight of the solvent), (b) polyethylene glycol monooleate (with 9 units of ethylene oxide) (10 to 40% by weight of the solvent), (c) propylene glycol (0 to 20% by weight of the solvent), (d) triethanolamine (0-15% by weight of the solvent), and (e) diamidoamine (0-7% by weight of the solvent). Alternatively, the surfactant choice for the release aid may also be a mixture of PEG 400 dioleate, PEG 600 dioleate, mineral oil and/or vegetable oil. Additionally, other secondary amines, such as diethanolamine and monoethanolamine, also may be included if desired.

In other embodiments, the quaternary imidazoline release aid can also be used in conjunction with oil based release aids to permit further flexibility in controlling the creping process. The imidazoline-based release aid itself may have an adjustable viscosity, which can be varied by using a mixture of high boiling compounds as a solvent for the quaternized imidazoline. For example, desired, these release agent compositions can also comprise or, alternatively, can be selected from, a mineral oil, a vegetable oil, or a blend thereof. Alternatively, the release aid can include or be selected from an oil-based dispersion, including for example, an oil-based dispersion comprising a paraffinic oil, a naphthenic oil, a vegetable oil or a blend or combination thereof.

Also if desired, the release agent compositions can further comprise a nonionic surfactant. Release agent compositions can further comprise a surfactant with a hydrophilic-lipophilic balance (HLB) less than about 15. In further embodiments, the release agent compositions can further comprise a surfactant with a hydrophilic-lipophilic balance (HLB) less than about 12; alternatively, less than about 10; or alternatively, less than about 8. In addition, if desired, the release agent compositions can further comprise a cationic or anionic emulsifying agent if desired. Anti-forming agents may also be used in various embodiments, for example, the release agent compositions can further comprise an anti-foaming agent selected from a sulfonated oil, an organic phosphate, a polyether, and a silicone fluid. Compatible combinations thereof may also be used.

The secondary and tertiary amine moieties in amidoamine and imidazoline release aids also can constitute suitable reactive modifiers, as such compounds are able to influence the thermosetting process of a PAE adhesive composition containing a reactive, lightly crosslinked PAE-type polymer. Such low molecular weight compounds with a secondary or tertiary amine group are water soluble and compatible with the PAE-type adhesive composition of the present disclosure. For example, quaternized imidazoline is a major component of a release aid disclosed in U.S. Pat. No. 4,109,094, and the cyclization product will normally contain about 8-10% primary and secondary amine groups. During the quaternization of the imidazoline, the unreacted amidoamine is also converted to a tertiary amine. During the creping process, such as on a Yankee dryer, the temperature of the dryer surface reaches 100-105° C. At that temperature, and in the presence of water, the derivatives of imidazoline can hydrolyze yielding reactive amine functionality that then serve as reactive modifiers.

Polyether Component.

As disclosed, the release composition for use in a creping process according to this disclosure can comprise: a) a release agent; and b) a polyether component. For example, the polyether component can be selected from a polypropylene glycol (PPG), a co-polymer of propylene glycol and ethylene glycol (co-PPG-PEG), a blend of polypropylene glycol (PPG) and polyethylene glycol (PEG), an alcohol polyether, an alkyl phenol polyether, and a combination thereof. Generally, the release composition blend of the release agent and the polyether component is designed to have a cloud point in water at standard pressure. Therefore, the release composition can generally have a cloud point in water at standard pressure at any temperature. For example, the release composition can have a cloud point in water at standard pressure of from about 1° C. to about 98° C.

Various polypropylene glycols (PPG) of different molecular weights are suitable for use in the release composition along with the various release agents (release aids). Also useful are copolymers of propylene glycol and ethylene glycol, particularly block copolymers of propylene glycol and ethylene glycol. For example, weight average molecular weights (Mw) of polypropylene glycols can be from about 450 Daltons to about 3000 Daltons. Weight average molecular weights (Mw) of block copolymers of propylene glycol and ethylene glycol can be from about 1000 Daltons to about 4000 Daltons. The mole percentage of propylene glycol and ethylene glycol can from about 1:1 to about 1:5. By way of example, the polyether component can comprise a polypropylene glycol (PPG) having a weight average molecular weight (Mw) from about 400 to about 3,500 Daltons. In another aspect, the polyether component can comprise a polyether component comprises a block copolymer of propylene glycol and ethylene glycol (co-PPG-PEG) having a weight average molecular weight (Mw) from about 300 to about 4,000 Daltons, and wherein the ratio of PPG monomer residues to PEG monomer residues is from 20:1 to 1:5.

In a further aspect, various alcohol polyethers or alkyl phenol polyethers of different molecular weights, or combinations thereof, are suitable for use in the release composition along with the various release agents (release aids). By way of example, types of alcohol polyethers and alkyl phenol polyethers that are useful according to this disclosure include, but are not limited to, alcohol ethoxylates (AEOs), alcohol propoxylates (APOs), and alkylphenol ethoxylates (APEOs). The alcohol ethoxylates (AEOs), alcohol propoxylates (APOs), and alkylphenol ethoxylates (APEOs) each contain two main molecular regions: (1) the oligoether region, which functions as a hydrophilic chain, and (2) the alkyl region which functions as a hydrophobic moiety. APEOs are similar in structure to alcohol polyethers, but they contain a benzene ring situated between the two regions found in alcohol polyethers.

Structures of AEOs, APOs and APEOs are illustrated below, where structure A shows alkylphenol ethoxylates (APEO), structure B illustrates alcohol ethoxylates (AEO), and structure C shows exemplary alcohol propoxylates (APO).

A

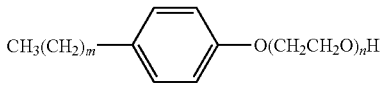

B $$CH_3(CH_2)_mO(CH_2CH_2O)_nH$$

C $$CH_3(CH_2)_mO(CH_2\overset{\overset{CH_3}{|}}{C}HO)_nH$$

In each of structures A, B, and C, m and n can be selected independently from a number from 1 to about 100; alternatively, from 1 to about 50; alternatively, from about 2 to about 40; alternatively, from about 2 to about 30; alternatively, from about 3 to about 25. In other embodiments, the molecular weights of the AEOs, APOs and APEOs illustrated in structures A, B, and C can be from about 100 to about 1,500; alternatively, from about 150 to about 1,200; alternatively, from about 175 to about 1,000; or alternatively, from about 200 to about 800.

A wide range of alcohol polyethers and alkyl phenol polyethers are known in the art, and standard methods of their synthesis can be employed. For example, the synthesis of APEOs can be based on a phenol which is alkylated, followed by ethoxylation using KOH/ethanol as a catalyst with a known ratio of ethylene oxide to the alkylphenol. A similar process is used for the formation of alcohol polyethers starting with fatty alcohols. Production of alcohol polyethers can be performed by reaction of ethylene oxide or propylene oxide with the fatty alcohols, in which either acidic or basic catalysts can be used for polyether formation. Moreover, if water is present during the synthesis, polyethylene or polypropylene glycols (PEGs or PPGs) can also be produced.

Adhesive Composition

According to aspects of this disclosure, there is provided a creping composition having a cloud point, the creping composition comprising a release composition as disclosed herein, in which the creping composition clouds at temperatures above its cloud point. If desired, the creping composition can further comprise an adhesive composition, which can be selected from any number of adhesive compositions useful in creping processes, including for example a polyamidoamine-epihalohydrin polymer composition.

According to an aspect, any type of polyamine-epihalohydrin (PAE) resin can be used as the creping adhesive in the composition of this disclosure, along with the release agent described herein. These creping adhesives are the reaction product of an epihalohydrin, preferably epichlorohydrin, and a polyamine resin, including, for example, polyalkylene polyamine resins and the specific class of polyamine resins known as polyamidoamine (PAA) resins. The polyalkylene polyamines include, for example, diethylenetriamine and dihexamethylenetriamine. Examples of polyalkylene polyamine-epihalohydrin resins are described in U.S. Pat. Nos. 2,595,935, 3,248,353, and 3,655,506. These PAA resins are made from a polyalkylene polyamine having at least one secondary amine group and a saturated aliphatic dicarboxylic acid or dicarboxylic acid derivative. Thus, the epihalohydrin is typically epichlorohydrin, but other epihalohydrins are also envisionsed, including such as epichlorohydrin, epibromohydrin, and epiiodohydrin, or any combination thereof. However, epichlorohydrin is typically the most common epihalohydrin used in this reaction step.

Examples of preparing polyamidoamine-epihalohydrin resins are described, for example, in U.S. Pat. No. 5,338,807 and Canadian Patent No. 979,579. These polyamine-epihalohydrin (PAE) resins are typically water-soluble and crosslinkable. According to an aspect, the polyamidoamine-epihalohydrin polymer composition can comprises a reactive, lightly crosslinked polyamidoamine-epihalohydrin polymer and at least 0.1% of covalent halogen by weight of polymer solids.

Due to the flexibility in the ability to manipulate the crosslinking process (that is, the weight ratio between the reactive, lightly crosslinked PAE-type polymer and the reactive modifier), one can tailor the creping adhesive composition of the present disclosure to a wide variety of paper machines. One particularly advantageous way to practice this disclosure is to add a reactive modifier to the release aid or release agent in a range of concentrations. In this way, one manipulates the creping process by varying the amount of reactive modifier in the release aid and the amount of release aid that is used. For example, suitable reactive modifiers include those disclosed in U.S. Patent Publication No. 20110284176, which is hereby incorporated by reference in its entirety. In the broad practice of the present composition and process, the weight ratio between creping adhesive and release aid can range from 10:90 to 1000:1.

General methods of preparing polyamidoamine-epihalohydrin polymers, that is the so-called "PAE-type" polymers are well known and are described, for example, in U.S. Pat. No. 2,926,116, U.S. Pat. No. 3,058,873 and U.S. Pat. No. 3,772,076, all of which are incorporated herein by reference in their entireties.

In accordance with the present disclosure, suitable reactive, lightly crosslinked PAE-type polymers for use in a creping adhesive composition comprise polymers prepared by reacting (1) a prepolymer of (a) a diacid, or an ester of a diacid, and (b) a polyamide containing secondary or tertiary amine groups with (2) an epihalohydrin. The epihalohydrin typically is selected from epichlorohydrin. The polyamide-amine groups are usually secondary amine groups derived from a polyalkylene polyamine, for example, polyethylene polyamines, polypropylene polyamines or polybutylene polyamines and the like. For example, the polyalkylene polyamine can be diethylene triamine, methyl bis(3-aminopropyl)-amine, triethylene tetramine, tetraethylene pentamine, dipropylene triamine, bishexamethylene triamine, bis-2-hydroxyethylethylene diamine, pentaethylylene hexamine, or hexaethylene heptamine, and the like. Usually, the polyamine is one of diethylenetriamine, methyl bis(3-aminopropyl)-amine, triethylene tetramine, or tetraethylene pentamine. The most often used polyamines are diethylenetriamine and methyl bis(3-aminopropyl)-amine.

The diacid can be selected from such acids as malonic acid, succinic acid, glutaric acid, adipic acid, suberic acid, sebacic acid and the like. Usually, the diacid is a saturated aliphatic dibasic carboxylic acid, often containing from about 3 to about 10 carbon atoms and mixtures thereof. Dicarboxylic acids containing from 4 to 8 carbon atoms are usually used, with adipic acid, or glutaric acid being most often used.

For example, to prepare a suitable prepolymer from the diacid and the polyalkylene polyamine, a mixture of the reactants can be heated at a temperature of about 110-250° C., usually about 125-200° C., and often about 160-200° C., at atmospheric pressure. In carrying out the reaction, an amount of dicarboxylic acid sufficient to react substantially completely with the primary amine groups of the polyalkylene polyamine but insufficient to react with the secondary amine groups to any substantial extent is generally used. This will usually involve a mole ratio of polyalkylene polyamine to dicarboxylic acid from about 0.9:1 to about 1.2:1. However, a mole ratio of from about 0.8:1 to about 1.4:1 can usually be used with quite satisfactory results.

Where a reduced pressure is employed, lower temperatures such as 75° C. to 150° C. may be utilized. The time of reaction depends on the temperatures and pressures that are used and will ordinarily vary from about ½ to 4 hours, although shorter or longer reaction times may be used depending on reaction conditions. In any event, the reaction is desirably continued to substantial completion for best results. This polycondensation reaction produces water as a byproduct, which is removed by distillation. At the end of this reaction, the resulting product usually is dissolved in water at a concentration of about 50% by weight total polymer solids.

Where a diester is used instead of diacid for reaction with the polyalkylene polyamine, the prepolymerization can be conducted at a lower temperature, preferably about 100-175° C. at atmospheric pressure. In this case, the byproduct will be an alcohol, the type of alcohol depending upon the identity of the diester. For instance, where a dimethyl ester is employed the alcohol byproduct will be methanol, while ethanol will be the byproduct obtained from a diethyl ester. Where a reduced pressure is employed, lower temperatures such as 75° C. to 150° C. may be utilized.

Polyamidoamine prepolymers that can be used for producing a reactive, lightly crosslinked polyamidoamine-epihalohydrin polymer that would be suitable in a creping adhesive composition of the present disclosure are usually synthesized under conditions leading to the formation of a pre-polymer composition typically having a weight average molecular weight (in Daltons) in the range of $10{,}000 \leq M_w \leq 300{,}000$, usually in the range of $10{,}000 \leq M_w \leq 100{,}000$, more usually in the range of $20{,}000 \leq M_w \leq 75{,}000$, and most often in the range of $25{,}000 \leq M_w \leq 65{,}000$, for example, about 40,000 Daltons. Conditions conducive to the preparation of suitable prepolymers are well known to those skilled in the art, and can be identified with routine experimentation.

To produce a reactive, lightly crosslinked PAE-type polymer suitable for preparing a creping adhesive composition of the present disclosure, the amount of epihalohydrin introduced for reaction with the prepolymer is controlled or limited. In particular, the mole ratio of epihalohydrin to secondary amine groups in the prepolymer typically is kept below about 1.5:1, that is, about 1.5 molecules of epihalohydrin for each secondary amine group in the prepolymer. The mole ratio of epihalohydrin to the secondary amine groups in the polyamide prepolymer is usually between about 0.05:1 and about 1.5:1, and more often is between about 0.05:1 and about 1.25:1. In particular, the mole ratio of epihalohydrin to the secondary amine groups in the prepolymer is often less than 1.2:1, more often is less than 1.1:1 and most often is less than 1:1 and is generally in the range of 0.1:1 to 0.8:1, and is more often in the range of 0.2:1 and 0.7:1 and is most often in the range of 0.2:1 to 0, 6:1.

As the available epihalohydrin, for example, epichlorohydrin, reacts with secondary amines distributed along the backbone of the polyamide prepolymer, the more reactive epoxide functionality is initially consumed. This reaction thus results in a structure that has the covalently bound halogen such as chlorine, of the partially reacted epichlorohydrin available for further reaction with another secondary amine. When the terminal halogen, such as chlorine, functionality reacts with a secondary amine on another polyamide prepolymer molecule (that is, it participates in an alkylation reaction), a bridge (crosslink) is formed between the two polymer chains and a chloride ion (via hydrochloric acid formation) is formed that is captured by a tertiary nitrogen in the form of an ammonium salt. A composition containing only PAE polymers with no residual reactive chlorine functionality is not self-reactive or thermosetting. In other words, the polymer is not self-crosslinkable. However, a PAE-type polymer that is only lightly crosslinked with an epihalohydrin, such as with epichlorohydrin, and having no residual reactive chlorine functionality still likely has multiple secondary amine groups; it is similar to the structure of the initial prepolymer with just some additional branching or inter-chain crosslinking. Additional secondary amines would be present and available for reaction with any other reactive chlorine functionality from different molecules having residual covalent bonded halogens (co-crosslinking process).

If none of the halogen (chlorine) functionality of the epihalohydrin is consumed, then the PAE polymer would not be crosslinked at all and the molecular weight and viscosity of the polyamide prepolymer would have changed very little by reaction with the epihalohydrin. Such a composition would be devoid of ionic chlorine and the total chlorine and covalent chlorine would be essentially the same. Such a composition represents the lower limit of a reactive, lightly crosslinked PAE polymer. In other words, applicants consider a reactive PAE polymer with no crosslinks at all to fall within the definition of lightly crosslinked, notwithstanding the possible difficulty or impracticality of being able to synthesize such material in practice. In accordance with the present disclosure, some amount of crosslinking generally is contemplated and expected. In that case, the resulting polymer will have a measurable amount of both covalent halogen (for example, covalent chlorine), and ionic halogen (for example, ionic chlorine).

The ratio between the covalent chlorine and the ionic chlorine depends to some extent on the ratio between epichlorohydrin and secondary amine and on the extent of the reaction conversion of covalent chlorine to ionic chlorine (crosslinking reaction). For example, the ionic chlorine/covalent chlorine ratio can also be altered by mixing two or more reactive, lightly crosslinked PAE resins, or by mixing one or more reactive, lightly crosslinked PAE resins with a PAE resin that is crosslinked more completely, such as a fully crosslinked (though generally lightly crosslinked) PAE resin.

As a general rule, a suitable PAE polymer composition for a creping adhesive composition of the present disclosure will comprise a reactive, lightly crosslinked PAE-type polymer and the composition will have a total chlorine content of 0.1 to 10.0% by weight of polymer solids and a covalent chlorine content of 0.02% to 10.0% by weight of polymer solids. More often, the total chlorine content will be between 0.1 and 8% by weight of polymer solids and the covalent chlorine content will be between 0.1% and 6% by weight of polymer solids. Even more often, the total chlorine content will be between 0.1% and 6% by weight of polymer solids, and especially between 0.1% and 4% of polymer solids, and the covalent chlorine content will be between 0.12% and 4% by weight of polymer solids, and especially between 0.15% and 3% by weight of polymer solids. Most of the time, a lightly crosslinked PAE-type polymer having a total chlorine content of between 0.1% and 3% by weight of polymer solids and especially between 0.1% and 2% of polymer solids, and a covalent chlorine content of 0.15% to 2% by weight of polymer solids and especially 0.15% to 1.5% by weight of polymer solids will be used in formulating an adhesive composition of the present disclosure. The ionic chloride content of a PAE polymer is the difference between the total chlorine content and the covalent chlorine content.

Again, because a suitable PAE polymer composition for a creping adhesive composition of the present disclosure will comprise a reactive, lightly crosslinked PAE polymer, a certain amount of polymers in the composition will have residual pendant halohydrin, for example, chlorohydrin, functionality on the polymer backbone. This pendant halohydrin is measured as covalent halogen (covalent chlorine). In suitable PAE polymer compositions for a creping adhesive composition of the present disclosure, the ratio (either on a mole or weight basis) between pendant chlorohydrin groups (covalent chlorine) and crosslinks (ionic chlorine) in the composition is usually between 0.01:1 and 100:1 (measured as the ratio of covalent chlorine:ionic chlorine). Often, the ratio between pendant chlorohydrin groups (covalent chlorine) and crosslinks (ionic chlorine) is between 0.05:1 and 10:1 and especially between 0.05:1 and 7.5:1. More often, the ratio between pendant chlorohydrin groups (covalent chlorine) and crosslinks (ionic chlorine) is between 0.05:1 and 7:1. Even more often, the ratio between pendant chlorohydrin groups (covalent chlorine) and crosslinks (ionic chlorine) is between 0.1:1 and 6:1. Most often, the ratio between pendant chlorohydrin groups (covalent chlorine) and crosslinks (ionic chlorine) is between 0.2:1 and 5:1. In particularly useful PAE polymer compositions for a creping adhesive composition of the present disclosure, the ratio between pendant chlorohydrin groups (covalent chlorine) and crosslinks (ionic chlorine) is between 0.25:1 and 2.5:1 and especially between 0.5:1 and 1.5:1.

In converting a polyamide prepolymer, formed as above-described, into a reactive, lightly crosslinked PAE-type polymer, the prepolymer is reacted with the epihalohydrin, usually epichlorohydrin, at a temperature from above about 0° C., more preferably from about 25° C., to about 100° C., and more often between about 35° C. to about 70° C. until the viscosity of a 20% solids solution at 25° C. has reached a viscosity of about a Gardener-Holdt C or higher. In accordance with the present disclosure, the extent of the reaction between the polyamide-epihalohydrin polymer and the epihalohydrin should be controlled so that the prepolymer is only lightly crosslinked with the epihalohydrin. The viscosity, measured using a Brookfield viscometer, for a 15% by weight solids solution generally should not exceed about 150 Centipoise (cP) (about FG on the Gardner Holdt scale) at 25° C. The Brookfield viscosity of the 15% by weight solids solution often will be at least about 5 cP (a viscosity of about A4 on the Gardner Holdt scale) at 25° C. More often, the Brookfield viscosity of the 15% by weight solids solution will be between 10 and 60 cP (a viscosity of about A3 to AB on the Gardner Holdt scale) at 25° C. Most often, the Brookfield viscosity of the 15% by weight solids solution will be between 12 and 25 cP (a viscosity of about A3 to A2 on the Gardner Holdt scale) at 25° C. Usually, the reaction should not be allowed to progress beyond the point where the viscosity, measured using a Brookfield viscometer, of a 20% solids solution at 25° C. has reached about 25 to 45 Centipoise (cP), (a viscosity of about A2 to A1a on the Gardner Holdt scale), normally, the viscosity should be no greater than 25 to 35 cP, (a viscosity of about A2-A1 on the Gardner Holdt scale) at 25° C.

The reaction between the polyamide prepolymer and the epihalohydrin is preferably carried out in aqueous solution to moderate the reaction. Although not necessary, pH adjustment can be done to increase or decrease the rate of residual crosslinking. When the desired viscosity is reached, sufficient water can be added to adjust the solids content of the lightly crosslinked PAE polymer solution to a desired amount, for example, to about 15 wt % more or less; the product can be cooled to about 25° C. and then stabilized to permit storage. While the solids content of the lightly crosslinked PAE polymer solution suitable for use as an adhesive is typically 15% by weight, the solids content generally could range between 10% and 35% by weight. One can improve the stability of the lightly crosslinked PAE polymer to resist gelation by adding sufficient acid to reduce the pH to less than about 6, usually to less than about 5, and most often to less than about 4. Any suitable inorganic or organic acid such as hydrochloric acid, sulfuric acid, methanesulfonic acid, nitric acid, formic acid, phosphoric acid and acetic acid may be used, as well as non-halogen containing acids, such as sulfuric acid.

The weight average molecular weight of suitable PAE polymer compositions for a creping adhesive composition of the present disclosure will broadly range from about 60,000 up to about 1,000,000 to 1,500,000 Daltons, more usually from about 150,000 to 800,000 Daltons, most often from about 300,000 to 450,000 Daltons. In particular, the reaction between the polyamide (for example, polyamidoamine) prepolymer and the halohydrin will have increased the molecular weight of prepolymers from 1.5 to 20 times, and usually from 2 to 10 times, from what it was originally.

Usually, the weight average molecular weight for a reactive, lightly crosslinked PAE-type polymer is in the range between 150,000 and 800,000 Daltons and most often between 300,000 and 450,000 Daltons. As known by those skilled in the polymer molecular weights can be determined using Gel Permeation Chromatography (GPC), which allows for the determination of a polymer's polydispersity index, as well as its viscosity molecular weight ($M_v$). Based on other data, the number average ($M_n$), the weight average ($M_w$) and the size average ($M_z$) molecular weights also can be determined.

Typical property values for suitable aqueous reactive, lightly crosslinked PAR-type polymers are as follows: viscosity at 25° C. of 5 cPs to 200 cPs (for example, 16 cPs); solids content of 8% to 30% by weight (for example, 15%); pH of 2.5 to 6.5 (for example, 4.7); ionic chlorine of 0.05% to 1.5% by weight (for example, 0.35%); covalent chlorine of 0.01% to 1.5% by weight, usually 0.1% to 1.5% by weight (for example, 0.30%).

The present disclosure is not limited to any specific manner for preparing a creping adhesive composition comprising a reactive, lightly crosslinked PAE polymer. For example, one can simply synthesize a single PAE-type polymer composition that itself constitutes a reactive, lightly crosslinked PAE polymer by using an appropriate amount of the epihalohydrin to synthesize the polymer from a suitable prepolymer and allowing the reaction to proceed until an intended balance of covalent chlorine and ionic chlorine is reached in the polymer composition. Alternatively, one can blend different PAE-type polymers having different levels of covalent chlorine and ionic chlorine to arrive at a composition having the intended balance between covalent chlorine and ionic chlorine. For example, one might blend a non-reactive, lightly crosslinked PAE polymer, that is, a PAE polymer which is fully crosslinked and in which the total chlorine and the ionic chlorine are substantially the same, with one or more separate PAE polymers that is/are crosslinked very little, if at all, where the total chlorine and the covalent chlorine are substantially the same. Other options for blending PAE polymers within the spectrum of different levels of crosslinking and different levels of reactivity will be apparent to those of ordinary skill in the art in view of the present disclosure.

Creping (Adhesive) Composition

This disclosure also provides for a creping composition having a cloud point, the creping composition comprising an adhesive composition and a release composition as disclosed herein, wherein the creping composition clouds at temperatures above its cloud point. This creping composition can include an adhesive composition, such as an adhesive composition comprising a polyamidoamine-epihalohydrin polymer composition. The polyamidoamine-epihalohydrin polymer composition comprises a reactive, lightly crosslinked polyamidoamine-epihalohydrin polymer and at least 0.1% of covalent halogen by weight of polymer solids. The epihalohydrin can be epichlorohydrin for example.

This, in this disclosure, there is provided a creping composition having a cloud point, the creping composition comprising an adhesive composition and a release composition as disclosed herein, wherein the polyamidoamine-epihalohydrin polymer composition is prepared by contacting under polymerization conditions:

a) a prepolymer of (1) a diacid, or an ester of a diacid, and (2) a polyamide containing secondary or tertiary amine groups; and b) an epihalohydrin, wherein the prepolymer has a weight average molecular weight (Mw) of 10,000 to 300,000 Daltons.

Moreover, the creping composition can include an adhesive in which the polyamidoamine-epihalohydrin polymer is partially crosslinked.

The creping composition according to claim 13, wherein the polyamidoamine-epihalohydrin polymer composition further comprises a reactive modifier having a molecular weight below about 5,000 Daltons, prepared by reacting a polyalkylenepolyamine with an electrophile.

As noted above, the adhesion properties of the adhesive system of the present invention can be systematically modified by varying the amount of crosslinking that can occur when the reactive, lightly crosslinked PAE-type polymer is dried by heating in the presence of a reactive modifier. Because adhesive crosslink density influences adhesive mechanical properties, such as the glass transition temperature ($T_g$) of the adhesive, by varying the amount of crosslinking which can occur in the adhesive composition one can influence the level of adhesion of the fibrous substrate onto the dryer surface, and accordingly one can control the relative ease or difficulty by which the fibrous substrate is released from the dryer surface. The amount of crosslinking typically is varied by altering the extent by which the PAE-type polymer is crosslinked during its preparation, and/or by altering the type and amount of the reactive modifier or other materials included in the adhesive composition.

The reactive modifiers are compounds having a chemical structure similar to the adhesive itself (for example, similar to prepolymer, amidoamine-based compounds, that form the foundation for the PAE-type polymer), but having a much lower molecular weight. Thus, suitable reactive modifiers have residual secondary and/or tertiary amine function. In particular, the weight average molecular weight of suitable reactive modifiers should generally be below about 5,000 Daltons, is usually below 2,000 Daltons and is most often below 1,000 Daltons. The lower limit for the reactive modifier's molecular weight is governed only by its volatility. The volatility of a reactive modifier cannot be so high such (the molecular weight cannot be so low) that the volatility of the reactive modifier interferes with the creping process. In particular, the reactive modifier is too volatile if heat associated with the creping process prevents a sufficient amount of the reactive modifier from being retained in the creping adhesive composition on the surface of the dryer during the creping operation, that is, if too much of the reactive modifier evaporates before it can influence the creping process then it is too volatile.

The reactive modifier is a compound that can control (that is, attenuate, inhibit or retard) the alkylation process (for example, by the formation of crosslinks by reaction between secondary amine moieties and pendant halohydrin moieties) by reacting with covalent halogen (chlorine) without causing a significant increase in the adhesive PAE polymer molecular weight. Thus, the reactive modifier provides a way to control the crosslinking process. Suitable reactive modifiers are capable of reacting with pendant halohydrin, chlorohydrin, moieties on the reactive, lightly crosslinked PAE-type polymer. Suitable reactive modifiers also can function as plasticizers for the PAE adhesive as well. The reactive modifier can be added to either the adhesive composition (that is, to the reactive, lightly crosslinked PAE-type polymer) or to a release aid, or could be applied independently to the dryer surface during the creping process. Blends of different reactive modifiers also can be used along with some other plasticizers (such as di-ethanol amine, tri-ethanol amine, glycerin or polyglycerin) for mixture with the creping adhesive composition.)

Suitable reactive modifiers can be produced by a reaction between a polyalkylenepolyamine, such as DETA (diethylenetriamine) or N-methyl-3,3'-diaminopropylamine (NMDAPA), and 2 moles of an electrophile such as a carboxylic acid, for example, acetic acid (AcA), methylene-bis-acrylamide (MBA) or urea. Adducts based on DETA, for example, retain residual secondary amine functionality, which can be further reacted with an additional electrophile, such as acrylamide (AAm), epichlorohydrin (Epi), or propylene glycoldiglycidalether (PGDGE) to create tertiary amines. Conditions suitable for preparing reactive modifiers from these materials are illustrated in U.S. Patent Publication No. 20010284176, and other suitable conditions will be apparent to those skilled in the art.

The creping composition according to this disclosure can further comprise a plasticizer selected from water soluble polyols, glycols, glycerol, sobitol, polyglycerin, polyethylene glycols, sugars, oligosaccharides, hydrocarbon oils, and blends thereof.

Creping Process

In accordance with another aspect of this disclosure, there is provided a method of creping a cellulosic fiber web, the method comprising:

a) providing a creping composition having a cloud point, wherein the creping composition clouds at temperatures above its cloud point, the creping composition comprising a release composition, wherein the release composition comprises a release agent and a polyether component;

b) applying the creping composition having a first temperature to a drying surface having a second temperature higher than the first temperature;

c) contacting a cellulosic fiber web to the drying surface such that the cellulosic fiber web adheres to the drying surface; and d) dislodging the cellulosic fiber web from the drying surface;

wherein the cloud point of the creping composition is above the first temperature and below the second temperature. If desired, the creping composition can further include an adhesive composition. Also if desired, the release composition can further include a nonionic surfactant.

The applying step of this method can comprise separately applying the creping composition and a reactive modifier to the drying surface for combination on the drying surface. Moreover, the adhesive composition and the release composition can be applied together as is typical, for example, in a weight ratio of adhesive composition to release composition from 10:90 to 1000:1. The drying surface onto which the creping composition is applied can be, for example, the drying surface of a Yankee Dryer or the drying surface of a through air drying (TAD) process. The applying step is carried out by applying the creping composition having a first temperature to a drying surface having a second temperature higher than the first temperature, such that the cloud point of the creping composition is reached or exceeded, clouding occurs, and the release mechanism is provided and/or enhanced.

When the creping composition further includes an adhesive composition, the PAE polymers for use as a creping adhesive composition in accordance with the present disclosure comprising reactive, lightly crosslinked PAE-type polymers are generally supplied as a concentrated aqueous dispersion, usually above about 20% by weight solids, and are then diluted in order to be easily sprayed onto a dryer surface, such as onto the cylinder of a Yankee dryer, or onto a semi-dry tissue web. As used herein, the term "aqueous dispersion" refers to adhesive compositions consisting predominantly of water and containing the reactive, lightly crosslinked PAE-type polymer homogeneously distributed throughout the composition. The essential element is the homogeneity of the composition. While it is not necessary for all of the components of the aqueous dispersion to be dissolved at the molecular level, the term "aqueous dispersion" does encompass the more restrictive term "aqueous solution".

Also as used herein, the terms "cellulosic fiber web, fibrous web, tissue paper web, paper web, web and cellulosic fiber product" all refer to sheets of paper made by a process which comprises forming a papermaking furnish, depositing the furnish onto a foraminous surface, removing water from the web (by gravity or vacuum-assisted drainage, with or without pressing, and by evaporation), and the steps of adhering the sheet in a semi-dry condition to a heated drying surface, such as a Yankee Dryer, completing the water removal by evaporation to an essentially dry state, removing the sheet by a creping blade such as a doctor blade, and winding the resultant sheet onto a reel. Typically, the moisture content of the web sheet, for example, paper, delivered to the creping equipment will be between 5% and 85% by weight. The web can be comprised of various types of natural and recycled fibers including wood pulps of chemical and mechanical types. The web can be composed of up to 100% recycled fibers. The fibers can comprise hardwood, softwood and cotton fibers. The tissue web can also contain particulate fillers, fines, as well as process chemicals used in the paper-making process such as strength additives, softeners, surfactants and organic polymers.

In accordance with the disclosed methods, the polyamidoamine-epihalohydrin polymer composition can have a range of chlorine content as described in detail, for example, the polyamidoamine-epihalohydrin polymer composition can have between 0.1 and 6% of covalent chlorine by weight of polymer solids. The polyamidoamine-epihalohydrin polymer composition can also further comprise a reactive modifier having a molecular weight below about 5,000 Daltons, prepared by reacting a polyalkylenepolyamine with an electrophile.

By way of example, the adhesive composition can be applied to the drying surface in an amount from 0.01 lb/ton to 2.2 lb/ton based on the dry weight of the adhesive composition and the dry weight of the cellulosic fiber being creped. In the disclosed method, the cellulosic fiber web can have a content of recycled fibers of from about 1% to about 100%. Also in accordance with this method, the cellulosic fiber web has a moisture content ranging from about 5% to about 85% by weight. The creping composition can further comprise a plasticizer selected from water soluble polyols, glycols, glycerol, sobitol, polyglycerin, polyethylene glycols, sugars, oligosaccharides, hydrocarbon oils, and blends thereof.

There are of course many different and specific embodiments in accordance with this disclosure. For example, and not as a limitation, in one aspect and embodiment, there is provided a creping composition having a cloud point, comprising an adhesive composition and a release composition, wherein:

the adhesive composition comprises a polyamidoamine-epichlorohydrin polymer;

the release composition comprises:

a) a release agent comprising a quaternary imidazoline compound, an imidazoline free base, an oil-based dispersion, or a combination thereof; and b) a polyether component comprising a polypropylene glycol (PPG), a co-polymer of propylene glycol and ethylene glycol (co-PPG-PEG), a blend of polypropylene glycol (PPG) and polyethylene glycol (PEG), and a combination thereof.

the release composition has a cloud point in water at standard pressure from about 1° C. to about 98° C.; and the creping composition clouds at temperatures above its cloud point.

EXAMPLES

Example 1

In the preparation of a release composition, water-insoluble components like quaternary Imidazoline can be dissolved into a cloud point surfactant before being adding to water. The cloud point surfactants can be selected from certain non-ionic surfactant oligomers or polymers containing polyoxyethylene and/or polyoxypropylene linkages, in which the cloud point feature exhibits reverse solubility versus temperature behavior in water. When this initial composition is then combined with water, the aqueous mixture is a clear solution at room temperature, which clouds out on heating. Both the surfactant and its solubilized component are now able to function as oil-like release agents at this higher temperature.

Example 2

Cloud point surfactants such as those described in Example 1 and generally disclosed herein can be combined with water soluble polymers like polyvinyl alcohol before being adding to water. The cloud point surfactants and water soluble polymers generally are miscible in each other. Upon addition of this mixture to water, the added components will phase separate, thereby depositing the polyvinyl alcohol onto the sheet. This composition can function as a release agent in this manner.

In this disclosure, the term "hydrocarbyl group" is used in accordance with the definition specified by IUPAC: a univalent group formed by removing a hydrogen atom from a hydrocarbon (that is, a group containing only carbon and hydrogen). Non-limiting examples of hydrocarbyl groups include linear, branched, and cyclic hydrocarbyl groups such as methyl, ethyl, n-propyl, isopropyl, n-butyl, isobutyl, and the like.

"Room temperature" is defined as a temperature of about 18° C. to about 25° C. In various examples, room temperature may be about 18° C., about 19° C., about 20° C., about 21° C., about 22° C., about 23° C., about 24° C., or about 25° C.

Unless otherwise specified, any carbon-containing group for which the number of carbon atoms is not specified can have, according to proper chemical practice, 1, 2, 3, 4, 5, 6, 7, 8, 9, 10, 11, 12, 13, 14, 15, 16, 17, 18, 19, 20, 21, 22, 23, 24, 25, 26, 27, 28, 29, or 30 carbon atoms, or any range or combination of ranges between these values. For example, unless otherwise specified, any carbon-containing group can have from 1 to 30 carbon atoms, from 1 to 25 carbon atoms, from 1 to 20 carbon atoms, from 1 to 15 carbon atoms, from 1 to 10 carbon atoms, or from 1 to 5 carbon atoms, and the like. Moreover, other identifiers or qualifying terms may be utilized to indicate the presence or absence of a particular substituent, a particular regiochemistry and/or stereochemistry, or the presence of absence of a branched underlying structure or backbone.

In any application before the United States Patent and Trademark Office, the Abstract of this application is provided for the purpose of satisfying the requirements of 37 C.F.R. §1.72 and the purpose stated in 37 C.F.R. §1.72(b) "to enable the United States Patent and Trademark Office and the public generally to determine quickly from a cursory inspection the nature and gist of the technical disclosure." Therefore, the Abstract of this application is not intended to be used to construe the scope of the claims or to limit the scope of the subject matter that is disclosed herein. Moreover, any headings that may be employed herein are also not intended to be used to construe the scope of the claims or to limit the scope of the subject matter that is disclosed herein. Any use of the past tense to describe an example that may otherwise be indicated as constructive or prophetic is not intended to reflect that the constructive or prophetic example has actually been carried out.

Applicants reserve the right to proviso out any selection, group, element, or aspect, for example, to limit the scope of any claim to account for a prior disclosure of which Applicants may be unaware.

Further attributes, features, and embodiments of the present invention can be understood by reference to the following numbered aspects of the disclosed invention. Reference to disclosure in any of the preceding aspects is applicable to any preceding numbered aspect and to any combination of any number of preceding aspects, as recognized by appropriate antecedent disclosure in any combination of preceding aspects that can be made. The following numbered aspects are provided:

1. A release composition for use in a creping process, the release composition comprising:
   a) a release agent comprising a quaternary imidazoline compound, an imidazoline free base, an oil-based dispersion, or a combination thereof; and
   b) a polyether component selected from a polypropylene glycol (PPG), a co-polymer of propylene glycol and ethylene glycol (co-PPG-PEG), a blend of polypropylene glycol (PPG) and polyethylene glycol (PEG), an alcohol polyether, an alkyl phenol polyether, and a combination thereof;

wherein the release composition has a cloud point in water at standard pressure from about 1° C. to about 98° C.

2. A release composition according to the preceding aspect, further comprising a nonionic surfactant.

3. The release composition according to any of the preceding aspects, further comprising a surfactant with a hydrophilic-lipophilic balance (HLB) less than about 15.

4. The release composition according to any of the preceding aspects, further comprising a cationic or anionic emulsifying agent.

5. The release composition according to any of the preceding aspects, further comprising an anti-foaming agent selected from a sulfonated oil, an organic phosphate, a polyether, and a silicone fluid.

6. The release composition according to any of the preceding aspects, wherein the release agent comprises a fatty quaternary imidazoline derived from a fatty acid.

7. The release composition according to any of the preceding aspects, wherein the release agent comprises a methyl sulfate or ethyl sulfate salt of a fatty quaternary imidazoline derived from a fatty acid.

8. The release composition according to any of the preceding aspects, wherein the release agent comprises a compound having the formula:

(I)

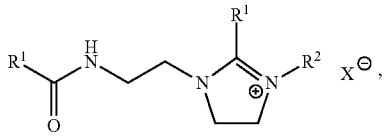

(II)

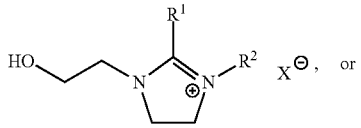

(III)

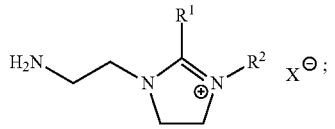

wherein $R^1$ is selected independently from a $C_6$ to $C_{22}$ hydrocarbyl moiety, $R^2$ is methyl or ethyl, and X is $[R^2SO_4]^-$.

9. The release composition according to any of the preceding aspects, wherein the release agent comprises an oil-based dispersion, an oil-based dispersion comprising a paraffinic oil, a naphthenic oil, a vegetable oil, or a combination thereof.

10. The release composition according to any of the preceding aspects, wherein the polyether component comprises polypropylene glycol (PPG) having a weight average molecular weight (Mw) from about 400 to about 3,500 Daltons.

11. The release composition according to any of the preceding aspects, wherein the polyether component comprises a block copolymer of propylene glycol and ethylene glycol (co-PPG-PEG) having a weight average molecular weight (Mw) from about 300 to about 4,000 Daltons, wherein the ratio of PPG monomer residues to PEG monomer residues is from 20:1 to 1:5.

12. A creping composition having a cloud point, the creping composition comprising a release composition according to any of the preceding aspects, wherein the creping composition clouds at temperatures above its cloud point.

13. The creping composition according to the preceding aspect, wherein the creping composition further comprises an adhesive composition.

14. The creping composition according to any of the preceding aspects, wherein the creping composition further comprises a plasticizer selected from water soluble polyols, glycols, glycerol, sobitol, polyglycerin, polyethylene glycols, sugars, oligosaccharides, hydrocarbon oils, and blends thereof.

15. A method of creping a cellulosic fiber web, the method comprising:
   a) providing a creping composition having a cloud point, wherein the creping composition clouds at temperatures above its cloud point, the creping composition comprising a release composition, wherein the release composition comprises a release agent and a polyether component;
   b) applying the creping composition having a first temperature to a drying surface having a second temperature higher than the first temperature;

c) contacting a cellulosic fiber web to the drying surface such that the cellulosic fiber web adheres to the drying surface; and d) dislodging the cellulosic fiber web from the drying surface;

wherein the cloud point of the creping composition is above the first temperature and below the second temperature.

16. The method according to the preceding aspect, wherein creping composition further comprises an adhesive composition.

17. The method according to any of the preceding aspects, wherein the release composition further comprises a nonionic surfactant.

18. The method according to any of the preceding aspects, wherein the release composition further comprises a surfactant with a hydrophilic-lipophilic balance (HLB) less than about 15.

19. The method according to any of the preceding aspects, wherein the release composition further comprises a cationic or anionic emulsifying agent.

20. The method according to any of the preceding aspects, wherein the release composition further comprises an anti-foaming agent selected from a sulfonated oil, an organic phosphate, a polyether, and a silicone fluid.

21. The method according to any of the preceding aspects, wherein the release agent comprises a quaternary imidazoline compound, an imidazoline free base, an oil-based dispersion, or a combination thereof.

22. The method according to any of the preceding aspects, wherein the release agent comprises a fatty quaternary imidazoline derived from a fatty acid.

23. The method according to any of the preceding aspects, wherein the release agent comprises a methyl sulfate or ethyl sulfate salt of a fatty quaternary imidazoline derived from a fatty acid.

24. The method according to any of the preceding aspects, wherein the release agent comprises a compound having the formula:

(I)

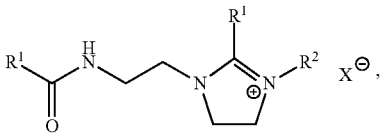

(II)

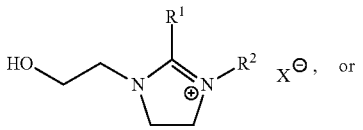

(III)

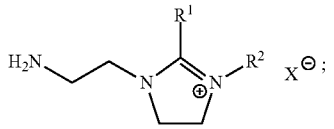

wherein $R^1$ is selected independently from a $C_6$ to $C_{22}$ hydrocarbyl moiety, $R^2$ is methyl or ethyl, and X is $[R^2SO_4]^{-1}$.

25. The method according to any of the preceding aspects, wherein the release agent comprises an oil-based dispersion, the an oil-based dispersion comprising a paraffinic oil, a naphthenic oil, a vegetable oil, or a combination thereof.

26. The method according to any of the preceding aspects, wherein the polyether component is selected from a polypropylene glycol (PPG), a co-polymer of propylene glycol and ethylene glycol (co-PPG-PEG), a blend of polypropylene glycol (PPG) and polyethylene glycol (PEG), an alcohol polyether, an alkyl phenol polyether, and a combination thereof.

27. The method according to any of the preceding aspects, wherein the polyether component comprises polypropylene glycol (PPG) having a weight average molecular weight (Mw) from about 400 to about 3,500 Daltons.

28. The method according to any of the preceding aspects, wherein the polyether component comprises a block copolymer of propylene glycol and ethylene glycol (co-PPG-PEG) having a weight average molecular weight (Mw) from about 300 to about 4,000 Daltons, wherein the ratio of PPG monomer residues to PEG monomer residues is from 20:1 to 1:5.

29. The method according to any of the preceding aspects, wherein the drying surface is a drying surface of a Yankee Dryer.

30. The method according to any of the preceding aspects, wherein the drying surface is a drying surface of a through air drying (TAD) process.

31. The method according to any of the preceding aspects, wherein the cellulosic fiber web has a content of recycled fibers of from about 1% to about 100%.

32. The method according to any of the preceding aspects, wherein the cellulosic fiber web has a moisture content ranging from about 5% to about 85% by weight.

33. The method according to any of the preceding aspects, wherein the creping composition further comprises a plasticizer selected from water soluble polyols, glycols, glycerol, sobitol, polyglycerin, polyethylene glycols, sugars, oligosaccharides, hydrocarbon oils, and blends thereof.

34. A creping composition having a cloud point, comprising a release composition, wherein:

the release composition comprises:

a) a release agent comprising a quaternary imidazoline compound, an imidazoline free base, an oil-based dispersion, or a combination thereof; and b) a polyether component comprising a polypropylene glycol (PPG), a co-polymer of propylene glycol and ethylene glycol (co-PPG-PEG), a blend of polypropylene glycol (PPG) and polyethylene glycol (PEG), an alcohol polyether, an alkyl phenol polyether, and a combination thereof;

the release composition has a cloud point in water at standard pressure from about 1° C. to about 98° C.; and the creping composition clouds at temperatures above its cloud point.

35. The creping composition according to the preceding aspect, wherein the creping composition further comprises an adhesive composition.

36. The creping composition according to any of the preceding aspects, wherein the adhesive composition comprises a polyamidoamine-epihalohydrin polymer composition.

37. A release composition for use in a creping process, the release composition comprising:

a) a release agent; and b) a polyether component;

wherein the release composition has a cloud point in water at standard pressure from about 1° C. to about 99° C.

38. The release composition according to the preceding aspect, wherein the release composition has a cloud point in water at standard pressure from about 5° C. to about 95° C.

39. The release composition according to any of the preceding aspects, wherein the release composition has a cloud point in water at standard pressure from about 15° C. to about 90° C.

40. A creping composition having a cloud point, comprising a release composition, wherein:

the creping composition clouds at temperatures above its cloud point;

the release composition comprises:

a) a release agent; and b) a polyether component;

the release composition has a cloud point in water at standard pressure from about 1° C. to about 99° C.

41. The creping composition according to the preceding aspect, wherein the release composition has a cloud point in water at standard pressure from about 5° C. to about 95° C.

42. The creping composition according to any of the preceding aspects, wherein the release composition has a cloud point in water at standard pressure from about 15° C. to about 90° C.

43. A method of preparing a release composition, the method comprising:

a) combining a water insoluble release agent with a cloud point surfactant to form a first composition, wherein the cloud point surfactant exhibits reverse solubility versus temperature behavior in water; and b) combining the first composition with water to form a release composition, wherein the release composition is clear at room temperature and clouds at temperatures above room temperature.

44. The method according to the preceding aspect, wherein the release agent is selected from a quaternary imidazoline compound, an imidazoline free base, an oil-based dispersion, and any combination thereof.

45. The method according to any of the preceding aspects, wherein the cloud point surfactant is a polyether component selected from a polypropylene glycol (PPG), a co-polymer of propylene glycol and ethylene glycol (co-PPG-PEG), a blend of polypropylene glycol (PPG) and polyethylene glycol (PEG), an alcohol polyether, an alkyl phenol polyether, and a combination thereof.

46. A method of using a release composition, the method comprising:

a) combining a water soluble polymer with a cloud point surfactant to form a miscible composition, wherein the cloud point surfactant exhibits reverse solubility versus temperature behavior in water; and b) combining the miscible composition with water to form a release composition, wherein the water soluble polymer phase separates from water upon combining the miscible composition with water.

47. The method according to the preceding aspect, wherein the water soluble polymer is selected from a polyvinyl alcohol.

48. The method according to any of the preceding aspects, wherein the cloud point surfactant is a polyether component selected from a polypropylene glycol (PPG), a co-polymer of propylene glycol and ethylene glycol (co-PPG-PEG), a blend of polypropylene glycol (PPG) and polyethylene glycol (PEG), an alcohol polyether, an alkyl phenol polyether, and a combination thereof.

I claim:

1. A release composition for use in a creping process, comprising:

a release agent comprising a compound having formula:

(B)

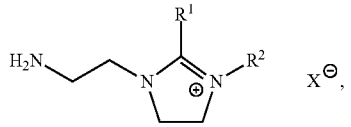

wherein $R^1$ is a $C_6$ to $C_{22}$ hydrocarbyl moiety, $R^2$ is methyl or ethyl, and $X^-$ is $[R^2SO_4]^-$; and a polyether component comprising a polypropylene glycol (PPG), a co-polymer of propylene glycol and ethylene glycol (co-PPG-PEG), a blend of polypropylene glycol (PPG) and polyethylene glycol (PEG), an alcohol polyether, an alkyl phenol polyether, or any combination thereof.

2. The release composition according to claim 1, further comprising: a sulfonated oil.

3. The release composition according to claim 1, wherein the release agent further comprises the compound having formula:

(A)

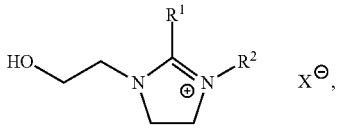

wherein $R^1$ is a $C_6$ to $C_{22}$ hydrocarbyl moiety, $R^2$ is methyl or ethyl, and $X^-$ is $[R^2SO_4]^-$.

4. The release composition according to claim 1, wherein the release agent further comprises an imidazoline free base.

5. The release composition according to claim 1, wherein the release agent further comprises an oil-based dispersion, the oil-based dispersion comprising a paraffinic oil, a naphthenic oil, or a combination thereof.

6. The release composition according to claim 1, wherein the release agent further comprises a sulfonated oil and an oil-based dispersion, wherein the oil-based dispersion comprises a paraffinic oil, a naphthenic oil, or a combination thereof.

7. A creping composition, comprising:

a release agent comprising a compound having formula:

(B)

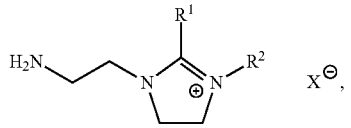

wherein $R^1$ is a $C_6$ to $C_{22}$ hydrocarbyl moiety, $R^2$ is methyl or ethyl, and $X^-$ is $[R^2SO_4]^-$; and a polyether component.

8. The creping composition according to claim 7, wherein the creping composition further comprises an adhesive composition.

9. The creping composition according to claim 8, wherein the adhesive composition comprises a polyamidoamine-epihalohydrin polymer composition.

10. The creping composition according to claim 7, wherein the creping composition further comprises a sulfonated oil, an imidazoline free base, and an oil-based dispersion, wherein the oil-based dispersion comprises a paraffinic oil, a naphthenic oil, or a combination thereof.

11. The creping composition according to claim 7, wherein:

the release agent further comprises a paraffinic oil.

12. The creping composition according to claim 7, wherein the release agent further comprises a compound having formula:

(C)

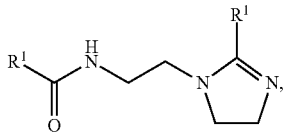

wherein each $R^1$ is a $C_6$ to $C_{22}$ hydrocarbyl moiety.

13. The creping composition according to claim 7, wherein the release agent further comprises a compound having formula:

(D)

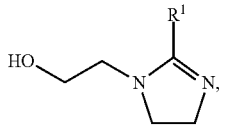

wherein $R^1$ is a $C_6$ to $C_{22}$ hydrocarbyl moiety.

14. The creping composition according to claim 7, wherein the release agent further comprises the compound having formula:

(A)

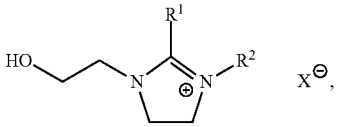

wherein $R^1$ is a $C_6$ to $C_{22}$ hydrocarbyl moiety, $R^2$ is methyl or ethyl, and $X^-$ is $[R^2SO_4]^-$.

15. The creping composition according to claim 7, wherein the release agent further comprises a naphthenic oil.

16. The creping composition according to claim 7, wherein the polyether component comprises:

a) polypropylene glycol (PPG) having a weight average molecular weight (Mw) from about 400 to about 3,500 Daltons;

b) a block copolymer of propylene glycol and ethylene glycol (co-PPG-PEG) having a weight average molecular weight (Mw) from about 300 to about 4,000 Daltons, wherein the ratio of PPG monomer residues to PEG monomer residues is from 20:1 to 1:5; or c) combinations thereof.

17. A method for creping a cellulosic fiber web, comprising:

applying a creping composition having a first temperature to a drying surface having a second temperature higher than the first temperature, wherein the creping composition has a cloud point, wherein the creping composition comprises a release composition, and wherein the release composition comprises:

a release agent comprising a compound having formula:

(B)

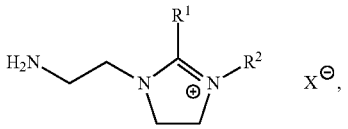

wherein $R^1$ is a $C_6$ to $C_{22}$ hydrocarbyl moiety, $R^2$ is methyl or ethyl, and $X^-$ is $[R^2SO_4]^-$; and a polyether component comprising a polypropylene glycol (PPG), a co-polymer of propylene glycol and ethylene glycol (co-PPG-PEG), a blend of polypropylene glycol (PPG) and polyethylene glycol (PEG), an alcohol polyether, an alkyl phenol polyether, or any combination thereof;

adhering a cellulosic fiber web to the drying surface; and dislodging the adhered cellulosic fiber web from the drying surface.

18. The method according to claim 17, wherein:

the release agent further comprises a sulfonated oil and an oil-based dispersion, wherein the oil-based dispersion comprises a paraffinic oil, a naphthenic oil, or a combination thereof.

* * * * *